US006512446B2

(12) United States Patent
Wang et al.

(10) Patent No.: US 6,512,446 B2
(45) Date of Patent: Jan. 28, 2003

(54) OVER-CURRENT PROTECTION APPARATUS

(75) Inventors: David Shau-Chew Wang, Taipei (TW); Yun-Ching Ma, Taipei Hsien (TW); Chiung-Huei Shieh, Chang-Hua (TW)

(73) Assignee: Polytronics Technology Corporation, Hsinchu (TW)

( * ) Notice: Subject to any disclaimer, the term of this patent is extended or adjusted under 35 U.S.C. 154(b) by 0 days.

(21) Appl. No.: 09/996,145

(22) Filed: Nov. 28, 2001

(65) Prior Publication Data

US 2002/0109576 A1 Aug. 15, 2002

(30) Foreign Application Priority Data

Dec. 30, 2000 (TW) ..... 089128416

(51) Int. Cl.[7] ..... H01C 7/10
(52) U.S. Cl. ..... 338/22 R; 252/511
(58) Field of Search ..... 338/22 R; 252/510, 252/511

(56) References Cited

U.S. PATENT DOCUMENTS

| | | | | |
|---|---|---|---|---|
| 5,378,407 A | | 1/1995 | Chandler et al. | |
| 5,410,435 A | * | 4/1995 | Sakai et al. | 360/48 |
| 5,580,493 A | | 12/1996 | Chu et al. | |
| 5,801,612 A | | 9/1998 | Chandler et al. | |

* cited by examiner

*Primary Examiner*—Karl D. Easthom

(57) ABSTRACT

The present invention discloses an over-current protection apparatus, which comprises a current-sensitive element and at least two electrodes. The current-sensitive element is composed of a positive temperature coefficient (PTC) conductive composition, which includes at least one polymer, a conductive filler and a non-conductive filler. The melting point of the polymer is greater then 110° C., and the vicat softening point of the polymer is smaller than 110° C. for improving the conductivity and thermal stabilization of the over-current protection apparatus.

24 Claims, 2 Drawing Sheets

OVER-CURRENT PROTECTION APPARATUS

BACKGROUND OF THE INVENTION

1. Field of the Invention

The present invention relates to an over-current protection apparatus, and more particularly, to an over-current protection apparatus with a current-sensitive element made by a positive temperature coefficient (PTC) conductive composition.

2. Description of the Prior Art

Since the portable electronic products (such as cellular phones, notebook computers, hand-held cameras and personal digital assistants, etc.) are getting more and more popular nowadays, over-current protection apparatuses for avoiding the portable electric products from over current or over temperature have become more and more important.

There are many kinds of conventional over-current protection apparatuses, such as a thermal fuse, bimetal or a positive temperature coefficient (PTC) over-current protection apparatus, etc. Nowadays, the PTC over-current protection apparatus has been widely applied for protecting batteries, especially secondary batteries, such as a nickel-hydrogen battery or a lithium battery, etc., due to its characteristics of being resettable, sensitive to temperature and reliable.

A PTC conductive composition acts as a current-sensitive element of the PTC over-current protection apparatus due to its temperature-sensitive resistance. The resistance of the PTC conductive composition is very low at a normal temperature so that the battery can operate normally. However, if an over-current or an over-temperature situation happens due to improper usage of the battery or other irregular cause, the resistance of the over-current protection apparatus will immediately increase for at least ten thousand times (such as over $10^4$ ohm) to a high resistance state. Therefore, the over current will be counterchecked and the objective to protect the circuit element of the battery is achieved.

Generally, the PTC over-current protection apparatus needs to have the following properties:

1. Low resistance: Even if the battery is discharged normally, a sudden and large current may occur according to the requirement of the electronic equipment. At this time, a voltage drop will happen if the resistance of the PTC over-current protection apparatus is too high, and the operation of the electronic equipment will be disturbed thereby. Therefore, the resistance of the PTC over-current protection apparatus needs to be less than 30 milliohm in a normal condition, preferably less than 20 milliohm.

2. Low switching temperature: When the temperature of the battery is over a threshold, the resistance of the PTC over-current protection apparatus will suddenly raise to a high resistance state, which is called "switching temperature." Generally speaking, the switching temperature of the PTC over-current protection apparatus needs to be less than 100° C. for preventing the battery from over-heat or burning down.

The PTC conductive composition is a crystalline polymer mixed with a conductive filler (such as carbon black or metal powder). Next, the PTC conductive composition is irradiated to perform a cross-linking reaction. The PTC conductive composition has a very low resistance at a room temperature. However, if the temperature rises over the switching temperature, the PTC conductive composition will switch to a high-resistance state immediately.

U.S. Pat. No. 5,801,612 discloses an over-current protection apparatus having a PTC conductive composition composed of conductive filler mixed polymer. The polymer applied in the above patent is a copolymer of polyolefin and polyacrytic acid. The PTC conductive composition is laminated with two electrodes and then irradiated to perform a cross-linking reaction. More specifically, the melting point of the polymer disclosed in the above patent needs to be less than 110° C.; the crystallinity of the polymer needs to be less than 40%, and the cross-linking level equivalent of the irradiation of the PTC conductive composition needs to be less than 20 Mrads. Therefore, the above over-current protection apparatus is capable of sensing the current change in a low temperature range (i.e., <110° C.) to provide a resistance switch for protecting the circuit and the battery. U.S. Pat. No. 5,580,493 and U.S. Pat. No. 5,378,407 also disclose a PTC conductive composition having a polymer made of a copolymer of polyolefin and polyacrylic acid. However, since the polyacrylic acid has a moisture absorption property, the stability of the PTC conductive composition containing acrylic-modified polymer will thereby decrease.

SUMMARY OF THE INVENTION

A major objective of the present invention is to provide an over-current protection apparatus having a current-sensitive element being at a low-resistance state when the temperature of the battery is normal; however, if the temperature of the battery raises to its switching temperature, the resistance of the current-sensitive element will increase immediately to a high-resistance state to countercheck the over current or over temperature of the battery.

Another objective of the present invention is to provide a method for rapidly and massively manufacturing a stable and temperature-sensitive over-current protection apparatus.

In order to achieve the above objective and to avoid the disadvantages of the prior art, the present invention discloses an over-current protection apparatus comprising a current-sensitive element and at least two electrodes. The current-sensitive element is composed of a positive temperature coefficient (PTC) conductive composition including at least one polymer, a conductive filler and a non-conductive filler: characterized in that the melting point of the polymer is greater than 110° C. and the vicat softening point is less than 110° C. for improving the conductivity and the sensibility to temperature of the over-current protection apparatus.

The present invention further discloses a method for manufacturing the over-current protection apparatus, comprising step (a) to step (d). In step (a), at least one polymer, conductive filler and non-conductive filler are well mixed to form a PTC conductive composition. In step (b), the PTC conductive composition is laminated with two electrodes to form a PTC sheet. In step (c), the PTC sheet is irradiated and has a cross-linking level equivalent to at least 20 Mrads, thus the PTC conductive composition will perform a higher degree of cross-linking reaction. In step (d), the PTC sheet is cut and the over-current protection apparatuses are formed thereby.

The foregoing and other objective and advantages of the invention and the manner by which the same is accomplished will be clearly shown in the following detailed description taken in conjunction with the accompanying drawings.

DETAILED DESCRIPTION OF THE INVENTION

Figure 1:
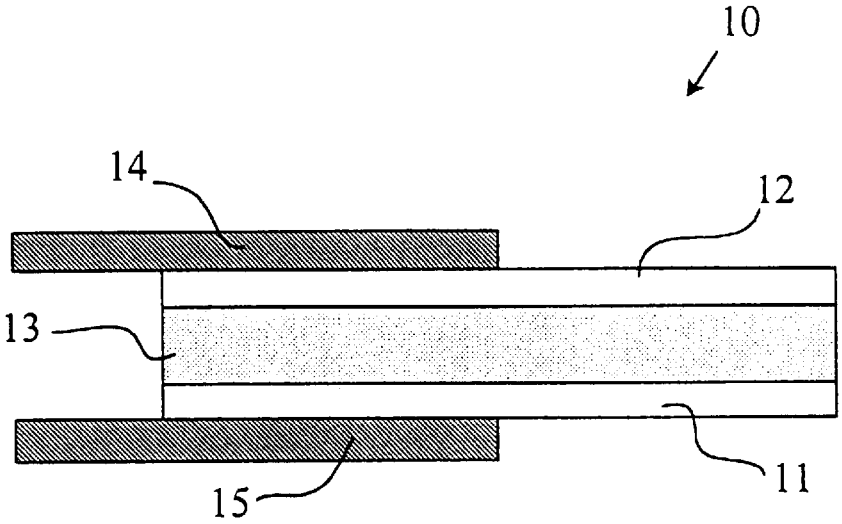
FIG. 1 depicts a cross-sectional view of a preferred embodiment of an over-current protection apparatus of the present invention.

FIG. 1 depicts a cross-sectional view of an over-current protection apparatus 10 of a preferred embodiment of the present invention. The over-current protection apparatus 10 comprises a current-sensitive element 13, two electrodes 11 and 12 and two metal conductive foils 14 and 15. The current-sensitive element 13 is made by PTC conductive composition, which comprises a polymer and conductive filler. The electrodes 11 and 12 are adhered to the surface of the current-sensitive element 13 for electrically connecting to the anode and cathode of the battery. The two metal conductive foils 14 and 15 are adhered to surfaces of the two electrodes 11 and 12 opposite to the current-sensitive element for contacting with the printed circuited board and the battery. However, the metal conductive foils 14 and 15 are not essential elements of the over-current protection apparatus according to the present invention.

Figure 2:
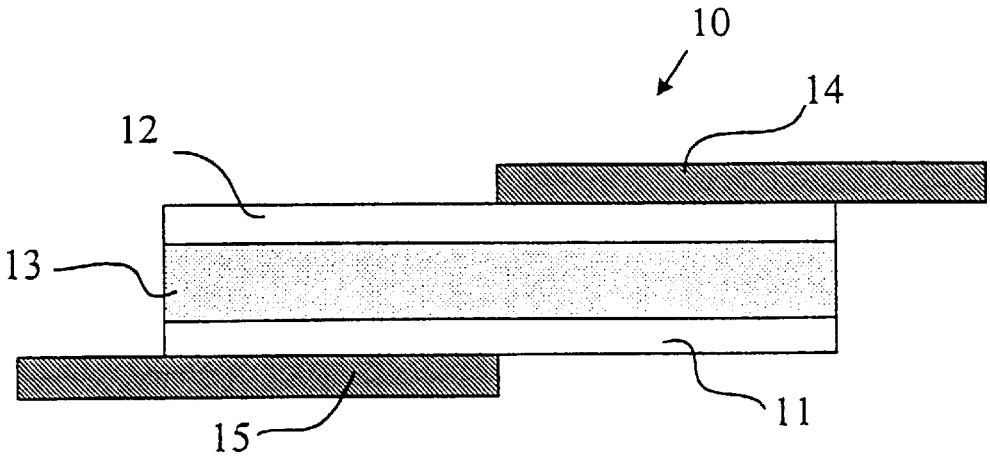
FIG. 2 depicts a cross-sectional view of another preferred embodiment of an over-current protection apparatus of the present invention.

FIG. 2 depicts a cross-sectional view of another preferred embodiment of the over-current protection apparatus 10 of the present invention. However, the metal conductive foils 14 and 15 are extended in opposite direction.

The polymer of the PTC conductive composition is composed of at least one polyolefin, such as polyethylene, polypropylene and polyoctene. Moreover, the melting point of the polymer is greater than 110° C. to improve the crystallizability and enhance the PTC behavior of the conductive composition, and the vicat softening point of the polymer is less than 110° C. to provide the over-current protection function of the apparatus 10 at a low temperature. The above-mentioned vicat softening point is measured according to ASTM, D1525. In addition, the conductive filler of the present invention is selected from a carbon black, metal powder and ceramic powder. The metal powder is nickel, silver or the mixture thereof. The ceramic powder is titanium carbide (TiC) or tungsten carbide (WC), and so on.

The PTC conductive composition further comprises a non-conductive filler to improve the toughness, conductivity and sensitivity to temperature of the current-sensitive element. The non-conductive filler is an inorganic or organic material; however, it is not a limitation to the present invention. The inorganic non-conductive filler is magnesium hydroxide, titanium oxide or calcium carbonate, and so on. The organic conductive filler is selected from the derivative of silicide, acrylic acid, amine, sulfide, carboxylic acid, aliphatic acid, ester and its salt or its amorphous polymer. In one preferred embodiment of the present invention the organic conductive filler is zinc stearate. Moreover, the PTC conductive composition further comprises an additive to improve the physical property. The additive comprises a photo initiator, cross-linking agent, coupling agent, dispersing agent, stabilizer or anti-oxidizing agent.

In the preferred embodiment of the present invention, the polymer, conductive filler, non-conductive filler and additive are mixed and pulverized. The weight ratio of the polymer is between 20% and 80% and, preferably, between 30% and 70%. The weight ratio of the conductive filler is between 20% and 90% and, preferably, between 30% and 70%. The weight ratio of the non-conductive filler is between 0.1% and 10% and, preferably, between 0.5% and 5%. The above-mentioned mixture is blended at a high temperature of 140° C.–250° C. and, preferably, at 180°C.–230° C.

The PTC conductive composition is laminated with two metal foils to form a PTC sheet. After laminating, the PTC conductive composition becomes a laminar current-sensitive element adhered with two metal foils. The material of the metal foils is nickel, copper or alloy, and the metal foils serve as electrodes of the present invention. The laminar current-sensitive element is formed by injecting a melted PTC conductive composition into a space between two metal foils or by thermally laminating the conductive composition with the two metal foils.

Next, the PTC sheet is irradiated to make the PTC conductive composition perform a cross-linking reaction to enhance the thermal stability and electrical property of the apparatus. The cross-linking level equivalent of the irradiation is at least 20 Mrads and, preferably, between 25 and 35 Mrads.

After performing the cross-linking reaction of the PTC conductive composition, the PTC sheet is cut to form a plurality of over-current protection apparatuses. The dimension of the present invention is smaller than 120 $mm^2$ and, preferably, between 40 $mm^2$ and 80 $mm^2$. The metal foils on both surface of the current-sensitive element are becoming electrodes 11 and 12 of the over current protection apparatus, after the PTC sheet is cut. Then, two metal conductive foils 14 and 15 are adhered to the surface of the electrodes 11 and 12, respectively, and serve as electrical connections in series to either anode or cathode of the battery. In one preferred embodiment of the present invention, the metal conductive foils 14 and 15 are made of a nickel.

The resistivity of the current-sensitive element of the invention is less than 2.0 ohm-cm at 20° C., and the thickness of the current-sensitive element is between 0.025 mm and 0.25 mm.

Figure 3:
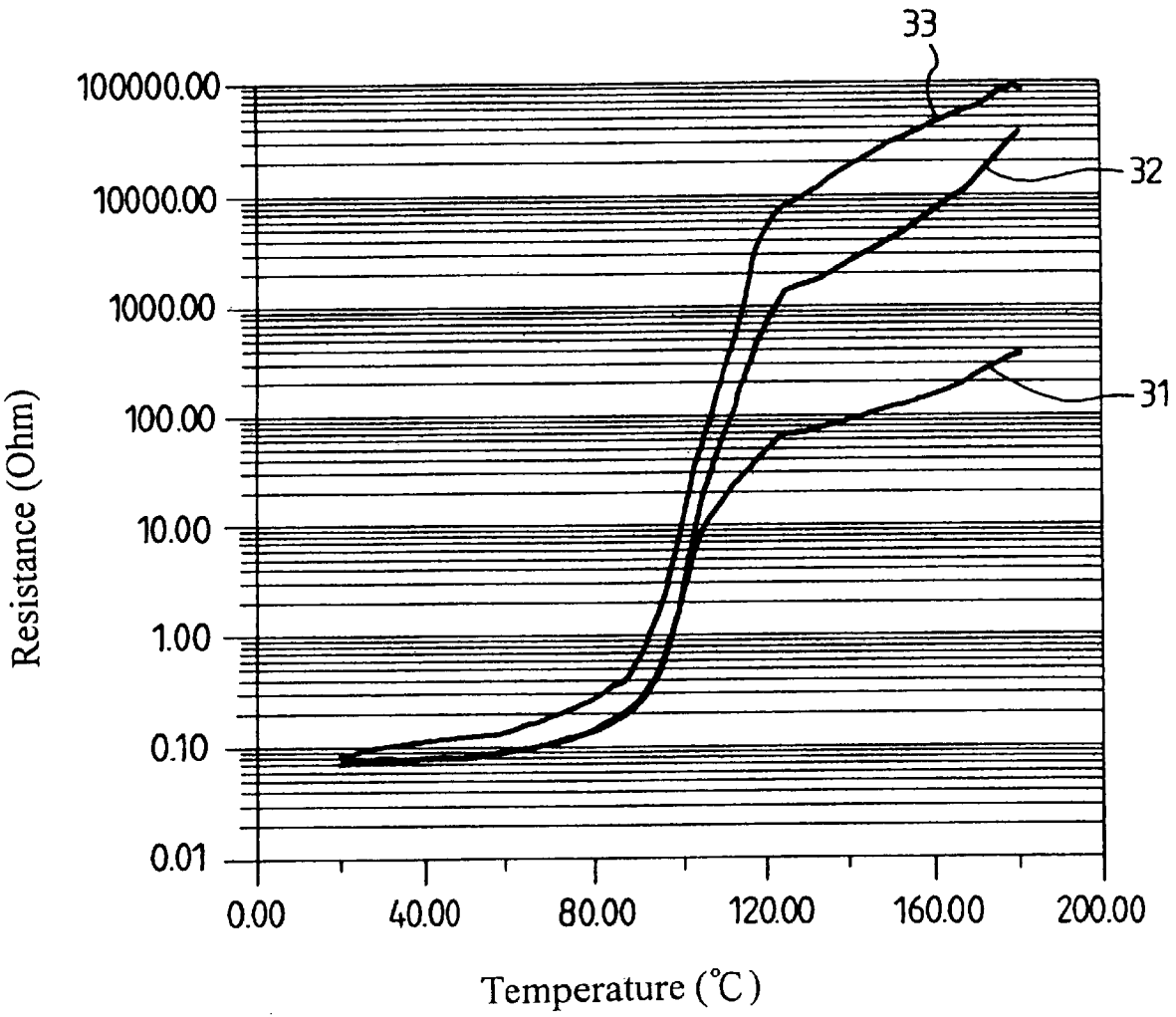
FIG. 3 shows a resistance vs. temperature diagram when applying different cross-linking level equivalents to the over-current protection apparatus of the present invention.

FIG. 3 shows a resistance vs. temperature diagram when applying different cross-linking level equivalent to the over-current protection apparatus of the present invention. The curve 31 represents the effect irradiated by a cross-linking level equivalent to 10 Mrads. The curve 32 represents the effect irradiated by a cross-linking level equivalent to 20 Mrads. The curve 33 represents the effect of irradiation by a cross-linking level equivalent to 30 Mrads. The more the irradiation dosage is, the higher the cross-linking level and the higher of the increased resistance of the PTC conductive composition are.

EXAMPLE 1

51% of the copolymer of polyethylene and polyoctene (Elite 5400 produced by Dow Chemical, having a melting point of 122.5° C. and a vicat softening point of 102° C.), 48% of carbon black (N550 produced by China Synthetic Rubber Corporation) and 1% of magnesium hydroxide (MGOH-650 produced by Ube Material Industries) were mixed in pulverizer for 3 minutes. Next, the pulverized mixture was blended at 200° C. for 15 minutes in a blender (Haake-600) to form a PTC conductive composition. The speed of the blender was kept at 40 rpm when feeding a raw material into the blender. After the raw material was fed into the blender, the speed was raised to 70 rpm. Then, the PTC conductive composition is drained and sliced. The sliced PTC conductive composition was placed in a space between two nickel-plated copper foils with a thickness of 0.05 mm. The PTC conductive composition faces to a rough surface of the nickel-plated copper foil. The above-mentioned nickel-plated copper foils were placed in between two Teflon plates with a thickness of 5 mm. Finally, the above-mentioned Teflon plates were placed in between two stainless plates with a thickness of 1 mm to form a multi-layer structure. The above-mentioned multi-layer structure was pressed in a hot pressing machine, which was preheated at 180° C. for 20 minutes. The pressure of the hot pressing machine was 50 kg/cm$^2$ at the beginning of pressing. After 5 minutes, the pressure was raised to 150 kg/cm$^2$ and kept for 10 minutes. Then, the Teflon plates and the stainless plates were removed and a PTC sheet was formed. The PTC conductive composition of the PTC sheet becomes a laminar current-sensitive element with a thickness of 0.13 mm adhered to the nickel-plated copper foil.

The PTC sheet was irradiated with $Co^{60}$ to perform a cross-linking reaction. The cross-linking level equivalent was about 30 Mrads. The cross-linked PTC sheet was cut to form a plurality of over-current protection apparatuses with a dimension of 5×12×0.13 mm. The nickel-plated copper foils serve as the electrodes of the over-current protection apparatus.

The two nickel foils with a dimension of 4×16×0.127 mm were respectively adhered to the surfaces of two electrodes of the over-current protection apparatus by tin paste in a high temperature (>240° C.) chamber for minimum 3 minutes. The terminal of the adhered nickel foil extends outward by 5 mm. Finally, the above-mentioned apparatus is thermally treated at 85° C., annealing at −45° C., and the resistance would decrease to 0.026 ohm.

The apparatus was then placed in a temperature-controlled oven to detect the relation between resistance and temperature. The resistance at 110° C. ($R_{110}$) and the trip surface temperature are shown in Table 1. The strip surface temperature was obtained by cutting the over-current protection apparatus off at 12V/10 A and then measuring the surface temperature by infrared thermometer.

EXAMPLE 2

47% of the copolymer of polyethylene and polyoctene (Elite 5400 produced by Dow Chemical, having a melting point of 122.5° C. and a vicat softening point of 102° C. ), 50% of carbon black (N660 produced by China Synthetic Rubber Corporation) and 3% of zinc stearate (Aldrich Chemical) were mixed in pulverizer for 3 minutes. Then, the pulverized mixture was blended in 200° C. for 15 minutes in a blender (Haake-600) to form a PTC conductive composition. The speed of the blender was kept at 40 rpm when feeding a raw material into the blender. After the raw material was fed into the blender, the speed was raised to 70 rpm. Then, two nickel-plated copper foil were wrapped around the upper steel wheel and lower steel wheel, respectively. The rough surface of the copper foil would face outward. The temperature of the steel wheel was 220° C. and the pressure was 100 kg/cm$^2$. The PTC conductive composition was extruded by an extruder and continuously flow through a gap between the upper steel wheel and the lower steel wheel. As the steel wheel is rolled, the PTC conductive composition was laminated to become a laminar current-sensitive element adhered with two nickel-plated copper foils. Therefore, a PTC sheet is formed.

Then, the PTC sheet was irradiated with Co60 to perform a cross-linking reaction. The cross-linking level equivalent was about 30 Mrads. The cross-linked PTC sheet was cut to form a plurality of over-current protection apparatuses with a dimension of 5×12×0.13 mm. The nickel-plated copper foils serve as the electrodes of the over-current protection apparatus.

The two nickel foils with a dimension of 4×16×0.127 mm were respectively adhered to the surface of two electrodes of the over-current protection apparatus by tin paste in a high temperature (>240° C.) chamber for a period of minimum 3 minutes. The terminal of the adhered nickel foil is extended outward by 5 mm. Finally, the above-mentioned apparatus were thermally treated at 85° C., annealing at −45° C., and the resistance would decrease to 0.023 ohm.

The apparatus was then placed in a temperature-controlled oven to detect the relation between resistance and temperature. The resistance at 110° C. ($R_{110}$) and the trip surface temperature are shown in Table 1. The trip surface temperature was obtained by cutting the over-current protection apparatus off at 12V/10 A and then measuring the surface temperature by infrared thermometer.

Comparative Example 1

The process of the Comparative Example 1 and Example 1 were the same; however, the cross-linking level equivalent of the irradiation dosage for the source $Co^{60}$ was about 10 Mrads.

Then, the apparatus was placed in a temperature-controlled oven to detect the relation between resistance and temperature. The resistance at 110° C. ($R_{110}$) and the trip surface temperature are shown in Table 1. The trip surface temperature was obtained by cutting the over-current protection apparatus off at 12V/10 A and then measuring the surface temperature by infrared thermometer.

Comparative Example 2

The process of the Comparative Example 1 and Example 1 are the same; however, the cross-linking level equivalent of the irradiation dosage was about 20 Mrads.

Then, the apparatus was placed in a temperature-controlled oven to detect the relation between resistance and temperature. The resistance at 110° C. ($R_{110}$) and the trip surface temperature are shown in Table 1. The trip surface temperature was obtained by cutting the over-current protection apparatus off at 12V/10 A and then measuring the surface temperature by infrared thermometer.

Comparative Example 3

The process of the Comparative Example 1 and Example 1 were the same. However, the polymer of the PTC conductive composition utilizes a high-density polyethylene (8050 produced by Formosa PetroChemical Co., having a melting point of 136° C. and a vicat softening point of 127° C.).

Then, the apparatus was placed in a temperature-controlled oven to detect the relation between resistance and temperature. The resistance at 110° C. ($R_{110}$) and the trip surface temperature are shown in Table 1. The trip surface temperature was obtained by cutting the over-current protection apparatus off at 12V/10 A and then measuring the surface temperature by infrared thermometer.

TABLE 1

| | Example 1 | Example 213 | Comparative Example 1 | Comparative Example 2 | Comparative Example 3 |
|---|---|---|---|---|---|
| Melting point (° C.) | 122.5 | 122.5 | 122.5 | 122.5 | 136 |
| Vicat soften point (° C.) | 102 | 102 | 102 | 102 | 127 |
| Equivalent (Mrad) | 30 | 30 | 10 | 20 | 30 |
| Thickness (mm) | 0.13 | 0.13 | 0.13 | 0.13 | 0.14 |

TABLE 1-continued

| | Example 1 | Example 213 | Comparative Example 1 | Comparative Example 2 | Comparative Example 3 |
|---|---|---|---|---|---|
| $R_{20}$ (mΩ) | 26 | 23 | 26 | 26 | 21 |
| $R_{110}$ (Ω) | 180 | 150 | 50 | 80 | 0.5 |
| Trip surface temperature (° C.) | 107 | 108 | 128 | 118 | 122 |

As shown in Table 1, the high temperature resistance ($R_{110}$) of the over-current protection apparatus will increase as the irradiating equivalent increases. Only the cross-linking level equivalent is at least 20 Mrads, the low temperature (<110° C.) characteristic of the over-current protection apparatus is obtained. When the vicat softening point of the polymer used in the Comparative Example 3 is over 110° C., the resistance of the over-current protection apparatus will decrease. Therefore, the melting point of the polymer of the over-current apparatus of the present invention needs to be greater than 110° C. and its vicat softening point needs to be smaller than 110° C. Moreover, the equivalent for performing a cross-linking reaction is at least 20 Mrads.

The methods and features of this invention have been sufficiently described in the above examples and descriptions. It should be understood that any modifications or changes without departing from the spirits of the invention are intended to be covered in the protection scopes of the invention.

What is claimed is:

1. An over-current protection apparatus, comprising:

a current-sensitive element composed of a positive temperature coefficient conductive composition including at least one polymer and a conductive filler dispersed in the polymer; and at least two electrodes laminated with the current-sensitive element;

characterized in that a melting point of the polymer is greater than 110° C., a vicat softening point of the polymer is smaller than 110° C., a thickness of the current-sensitive element is between 0.025 mm to 0.25 mm and a resistivity of the current-sensitive element at 20° C. is smaller than 2.0 ohm-cm.

2. The apparatus of claim 1, wherein the positive temperature coefficient conductive composition further includes a non-conductive filler dispersed in the polymer.

3. The apparatus of claim 2, wherein the non-conductive filler is an inorganic or an organic material.

4. The apparatus of claim 3, wherein the inorganic material is selected from magnesium hydroxide, titanium oxide or calcium carbonate.

5. The apparatus of claim 3, wherein the organic material is selected from the derivative of silicide, acrylic acid, amine, sulfide, carboxylic acid, aliphatic acid, ester and its salt, or amorphous polymer.

6. The apparatus of claim 1, wherein a surface of the electrode opposite to the current-sensitive element is adhered with a metal conductive foil.

7. The apparatus of claim 1, wherein the positive temperature coefficient conductive composition is irradiated and has a cross-linking level equivalent to at least 20 Mrads.

8. The apparatus of claim 1, wherein the positive temperature coefficient conductive composition is irradiated and has a cross-linking level equivalent to 25 to 35 Mrads.

9. The apparatus of claim 1, which is formed by the following steps:

mixing a polymer, conductive filler and a non-conductive filler to form the positive temperature coefficient conductive composition;

laminating the positive temperature coefficient conductive composition with the electrodes to form a positive temperature coefficient sheet, wherein the positive temperature coefficient conductive composition becomes a laminar current-sensitive element after laminating;

irradiating the positive temperature coefficient sheet with cross-linking level equivalent to at least 20 Mrads; and cutting the positive temperature coefficient sheet to form the over-current protection apparatuses.

10. The apparatus of claim 9, further comprising a step of adhering two metal conductive foils on surfaces of the electrodes opposite to the current-sensitive element.

11. An over-current protection apparatus, comprising a current-sensitive element and two electrodes, the current-sensitive element composed of a PTC conductive composition, and the conductive composition including:

at least one polymer, wherein a melting point of the polymer is greater than 110° C. and a vicat softening point is less than 110° C.; and a conductive filler dispersed in the polymer.

12. The apparatus of claim 11, wherein a weight ratio of the polymer is between 20% and 80%.

13. The apparatus of claim 11, wherein a weight ratio of the polymer is between 30% and 70%, preferably.

14. The apparatus of claim 11, wherein the conductive filler is made of a carbon black, metal powder or ceramic powder.

15. The apparatus of claim 11, wherein a weight ratio of the conductive filler is between 20% and 90%.

16. The apparatus of claim 11, wherein a weight ratio of the conductive filler is between 30% and 70%, preferably.

17. The apparatus of claim 11, wherein the PTC conductive composition further comprises a non-conductive filler dispersed in the polymer.

18. The apparatus of claim 17, wherein a weight ratio of the non-conductive filler is between 0.1% and 10%.

19. The apparatus of claim 17, wherein a weight ratio of the non-conductive filler is between 0.5% and 5%, preferably.

20. The apparatus of claim 17, wherein the non-conductive filler is made of an inorganic or organic material.

21. The apparatus of claim 20, wherein the inorganic non-conductive filler is selected from the group consisting of magnesium hydroxide, titanium oxide and calcium carbonate.

22. The apparatus of claim 20, wherein the organic non-conductive filler is selected from the group consisting of the derivative of silicide, acrylic acid, amine, sulfide, carboxylic acid, aliphatic acid, ester and its salt, and amorphous polymer.

23. The apparatus of claim 11, wherein the PTC conductive composition further comprises an additive to improve a physical property.

24. The apparatus of claim 23, wherein the additive is selected from a group consisting of a photo initiator, a cross-linking agent, a coupling agent, a dispersing agent, a stabilizer and an anti-oxidizing agent.

* * * * *